US007259693B2

(12) United States Patent
Miller et al.

(10) Patent No.: US 7,259,693 B2
(45) Date of Patent: Aug. 21, 2007

(54) AIR VESSEL TRACKING SYSTEM AND METHOD

(76) Inventors: Russell E. Miller, P.O. Box 235, 25595 Token Oak La., Chaptico, MD (US) 20621; Brian D. Dickerson, 22415 Ft. Lookout Rd., Leonard Town, MD (US) 20670; Teryle B. McKee, P.O. Box 114, Lexington Park, MD (US) 20653

( * ) Notice: Subject to any disclaimer, the term of this patent is extended or adjusted under 35 U.S.C. 154(b) by 412 days.

(21) Appl. No.: 10/823,988

(22) Filed: Apr. 14, 2004

(65) Prior Publication Data

US 2007/0146167 A1 Jun. 28, 2007

(51) Int. Cl.
*G08B 21/00* (2006.01)

(52) U.S. Cl. ..... 340/945; 340/961

(58) Field of Classification Search ..... 340/945, 340/961, 970, 963; 701/9, 301
See application file for complete search history.

(56) References Cited

U.S. PATENT DOCUMENTS

| | | | | |
|---|---|---|---|---|
| 5,382,954 | A * | 1/1995 | Kennedy et al. | 340/961 |
| 6,208,284 | B1 * | 3/2001 | Woodell et al. | 340/961 |
| 6,249,421 | B1 | 6/2001 | Jordan et al. | 342/41 |
| 6,587,046 | B2 | 7/2003 | Joao | 340/539.14 |
| 6,658,349 | B2 | 12/2003 | Cline | 701/207 |
| 6,668,218 | B1 | 12/2003 | Bulow et al. | 701/21 |
| 6,675,095 | B1 * | 1/2004 | Bird et al. | 701/301 |
| 6,677,889 | B2 | 1/2004 | Van Rees et al. | 342/41 |
| 6,687,637 | B2 | 2/2004 | Garabedian | 702/107 |
| 6,707,394 | B2 * | 3/2004 | Ishihara et al. | 340/970 |
| 6,778,906 | B1 * | 8/2004 | Hennings et al. | 701/301 |
| 6,940,426 | B1 * | 9/2005 | Vaida | 340/963 |
| 7,131,136 | B2 * | 10/2006 | Monroe | 340/945 |
| 7,161,501 | B1 * | 1/2007 | Lynch et al. | 340/971 |

* cited by examiner

*Primary Examiner*—John Tweel, Jr.
(74) *Attorney, Agent, or Firm*—Meyertons, Hood, Kivlin, Kowert & Goetzel, P.C.; Eric B. Meyertons

(57) ABSTRACT

A vessel tracking system may be used to detect and report an alert condition of a vessel (e.g., an aircraft). A vessel tracking system may monitor one or more travel (e.g., flight) characteristics of a vessel. At least one of the travel characteristics may be compared to one or more normal flight characteristics to assess an alert condition of the vessel. In some embodiments, the alert condition of the vessel may be reported (e.g., visually reported on a display). The alert condition of the vessel may be changed if at least one of the travel characteristics deviates from at least one normal travel characteristic. In certain embodiments, a boundary condition of an alert for the vessel may be modified if at least one of the travel characteristics deviates from at least one normal travel characteristic.

96 Claims, 10 Drawing Sheets

AIR VESSEL TRACKING SYSTEM AND METHOD

BACKGROUND

1. Field of the Invention

This invention relates generally to methods for detecting and reporting the state of a vessel during travel. An embodiment of the invention may be used detect and report the in-flight state of an air vessel.

2. Description of Related Art

Many systems have been developed for sensing and reporting vehicle or vessel traffic. These systems may incorporate data from one or more sensors to track and/or report a condition of a vessel. One example of a marine vessel tracking system is a system that uses reports transmitted from marine vessels to a tracking center to follow marine traffic, described in U.S. Pat. No. 6,658,349 to Cline, which is incorporated by reference as if fully set forth herein. Another example of such a system was developed as a government-off-the-shelf (GOTS) vessel tracking system for the U.S. Coast Guard by the Naval Air Warfare Center, Aircraft Division (NAWCAD) at Paxutent River, Maryland. This system is generally known as the Coast Guard Vessel Traffic System (CGVTS). U.S. Pat. No. 6,249,241 to Jordan et al., which is incorporated by reference as if fully set forth herein, describes the CGVTS as an improved radar harbor surveillance sensor, computer, and display system that monitors marine harbor traffic, provides advisories to vessels in areas selected by system operators, and provides the operators of the system with early warning of unacceptable traffic conflicts in a harbor.

The CGVTS replaced radar plan position indicator (PPI) displays with commercial computer systems able to present radar images and tracks overlaid on electronic charts. The CGVTS may be integrated with a set of closed-circuit television (CCTV) cameras and/or voice radio communication interfaces to provide a more complete vessel traffic management system. The CGVTS system was installed successfully in the ports of New York, Puget Sound, and San Francisco harbors between 1993 and 1995.

The original CGVTS system was designed to run on a UNIX operating system. Following introduction of the original CGVTS, code for operating the CGVTS has been ported to Microsoft Windows® operating systems (e.g., Windows® NT and Windows® 2000). The CGVTS may be operated on commercial-off-the-shelf (COTS) systems on the Microsoft Windows® operating system.

The system has been updated, refined, and renamed SureTrak™ by NAWCAD. Current versions of the SureTrak™ vessel tracking system include several functional components (e.g., sensors, data analysis components, tracking components). The SureTrak™ vessel tracking system includes a system architecture that allows functional components to operate on separate processors or allows functional components to be co-located on a single processor. Such a system architecture allows the vessel tracking system to be flexible in size and allows for integration of new or updated functional components more easily.

SUMMARY

In an embodiment, a vessel tracking system may be used to detect and report an alert condition of a vessel (e.g., an aircraft). The vessel tracking system may monitor one or more travel characteristics (e.g., flight characteristics) of the vessel. At least one of the travel characteristics may be compared to one or more normal travel characteristics to assess (e.g., determine) an alert condition of the vessel. In some embodiments, the alert condition of the vessel may be reported (e.g., visually reported on a display). An alert condition of the vessel may include an alert level for the vessel that corresponds to a danger level or threat level for the vessel based on the vessel's travel characteristics.

In certain embodiments, a vessel tracking system may assess (e.g., determine) a dynamic state of a vessel from one or more travel characteristics of the vessel. The dynamic state of the vessel may be compared to a normal dynamic state for the vessel. If at least one travel characteristic of the dynamic state of the vessel deviates from a predetermined value of at least one normal travel characteristic of the normal dynamic state, a boundary condition of an alert for the vessel may be modified (e.g., increased). An alert for the vessel may include, but is not limited to, a proximity alert, a boundary alert, and/or an exclusive area alert. An alarm may be provided when at least one boundary condition of the alert is crossed.

In some embodiments, one or more normal travel characteristics of a vessel may be modified based on a flight phase of the vessel. A flight phase of the vessel may include, but is not limited to, takeoff, enroute, approach, and landing. In certain embodiments, one or more of the travel characteristics of a vessel may be modified if at least one travel characteristic of the vessel deviates from a predetermined value of at least one normal travel characteristic of the vessel.

BRIEF DESCRIPTION OF THE DRAWINGS

Advantages of the present invention may become apparent to those skilled in the art with the benefit of the following detailed description and upon reference to the accompanying drawings in which.

Figure 1:
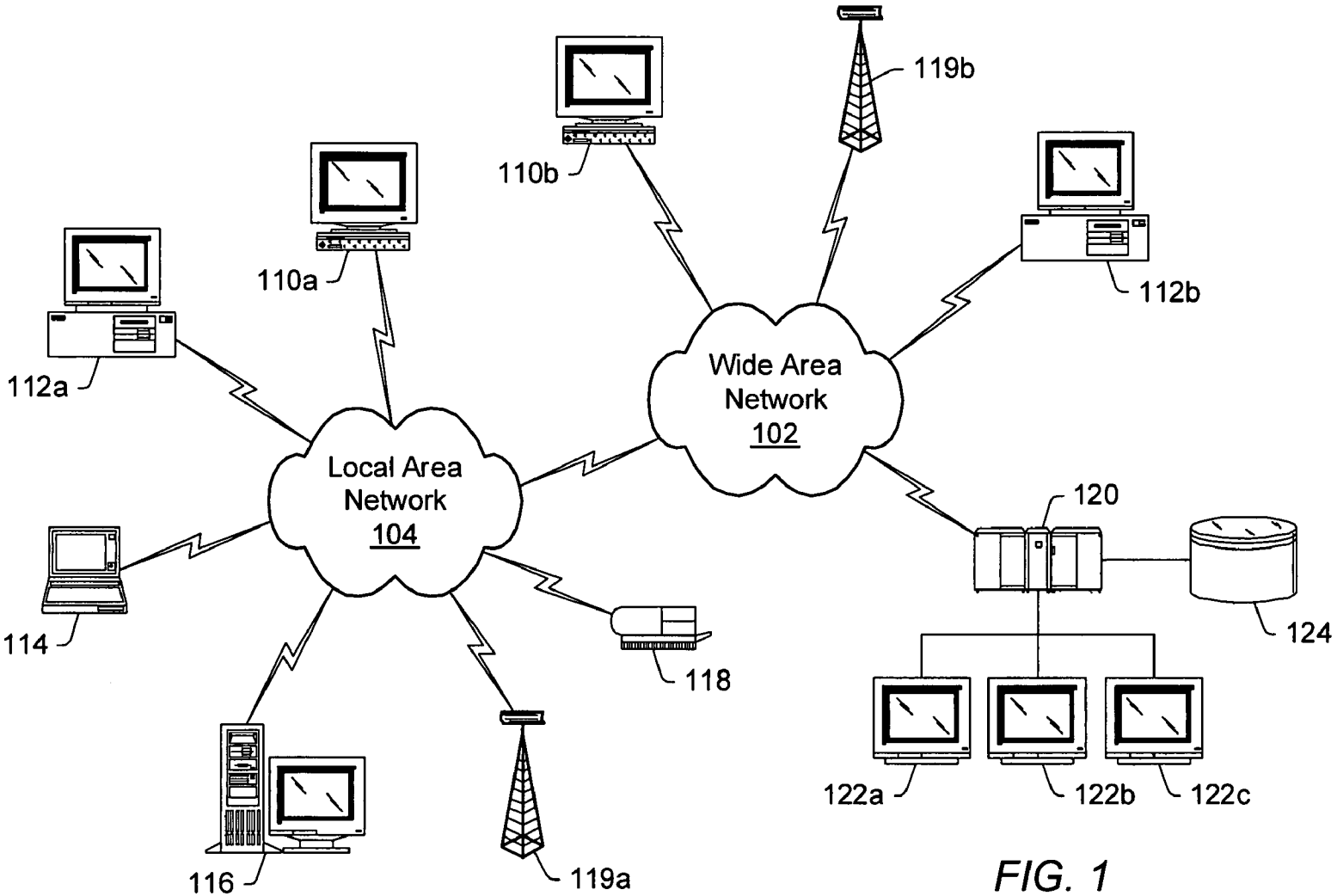
FIG. 1 illustrates an embodiment of a wide area network ("WAN") for use with various tracking system embodiments.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

In an embodiment, a path of a transportation vessel (e.g., an air vessel, a marine vessel, or a land transport vessel) may be followed (e.g., tracked or recorded). The vessel may be followed using a sensing system. Examples of sensing systems include, but are not limited to, air surveillance radar (FAA or military air surveillance radar (e.g., airport surveillance radar (ASR-8 or ASR-9), digital air surveillance radar (DASR-11), air route surveillance radar (ARSR-4 or ARSR-5))), telemetry radar, high-speed tracking radar, wide area multi-static dependent surveillance systems (MDS), surface surveillance radar (e.g., maritime surface surveillance radar or airport surface detection equipment (ASDE)), thermal and visual cameras (e.g., long range thermal and visual cameras), environmental monitor systems, or global positioning satellite (GPS) tracking.

In an embodiment, a computer system may acquire data from one or more sensing systems. One or more computer systems and one or more sensing systems may be linked over a wide area network ("WAN"). Data from sensing systems may be transferred to one or more computer systems in real-time or in near real-time. In certain embodiments, data may be acquired from one or more sensing systems at a primary location (e.g., a primary computer system or computer mainframe server) and then distributed to one or more clients (e.g., computer workstations or personal computers).

FIG. 1 illustrates an embodiment of a WAN. WAN 102 may be a network that spans a relatively large geographical area. The Internet is an example of WAN 102. WAN 102 typically includes a plurality of computer systems that may be interconnected through one or more networks. Although one particular configuration is shown in FIG. 1, WAN 102 may include a variety of heterogeneous computer systems and networks that may be interconnected in a variety of ways and that may run a variety of software applications.

One or more local area networks ("LANs") 104 may be coupled to WAN 102. LAN 104 may be a network that spans a relatively small area. Typically, LAN 104 may be confined to a single building or group of buildings. Each node (i.e., individual computer system or device) on LAN 104 may have its own CPU with which it may execute programs, and each node may also be able to access data and devices anywhere on LAN 104. Thus, LAN 104 may allow many users to share devices (e.g., printers) and data stored on file servers. LAN 104 may be characterized by a variety of types of topology (i.e., the geometric arrangement of devices on the network), of protocols (i.e., the rules and encoding specifications for sending data, and whether the network uses a peer-to-peer or user/server architecture), and of media (e.g., twisted-pair wire, coaxial cables, fiber optic cables, and/or radio waves).

LAN 104 may include a plurality of interconnected clients and servers. For example, each LAN 104 may include a plurality of interconnected computer systems and optionally one or more other devices such as one or more workstations 110*a*, one or more personal computers 112*a*, one or more laptop or notebook computer systems 114, one or more server computer systems 116, one or more network printers 118, and one or more sensing systems 119*a*. As illustrated in FIG. 1, an example LAN 104 may include one of each of computer systems 110*a*, 112*a*, 114, and 116 and one printer 118. LAN 104 may be coupled to other computer systems and/or other devices and/or other LANs 104 through WAN 102.

One or more mainframe computer systems 120 may be coupled to WAN 102. As shown, mainframe 120 may be coupled to a storage device or file server 124 and mainframe terminals 122*a*, 122*b*, and 122*c*. Mainframe terminals 122*a*, 122*b*, and 122*c* may access data stored in the storage device or file server 124 coupled to or included in mainframe computer system 120.

WAN 102 may also include computer systems connected to WAN 102 individually and not through LAN 104 (e.g., workstation 110*b*, personal computer 112*b*, and sensing system 119*b*). For example, WAN 102 may include computer systems or sensing systems that may be geographically remote and connected to each other through the Internet (e.g., using TCP-IP (transmission control protocol over internet protocol) connectivity and/or a client-server environment).

Figure 2:
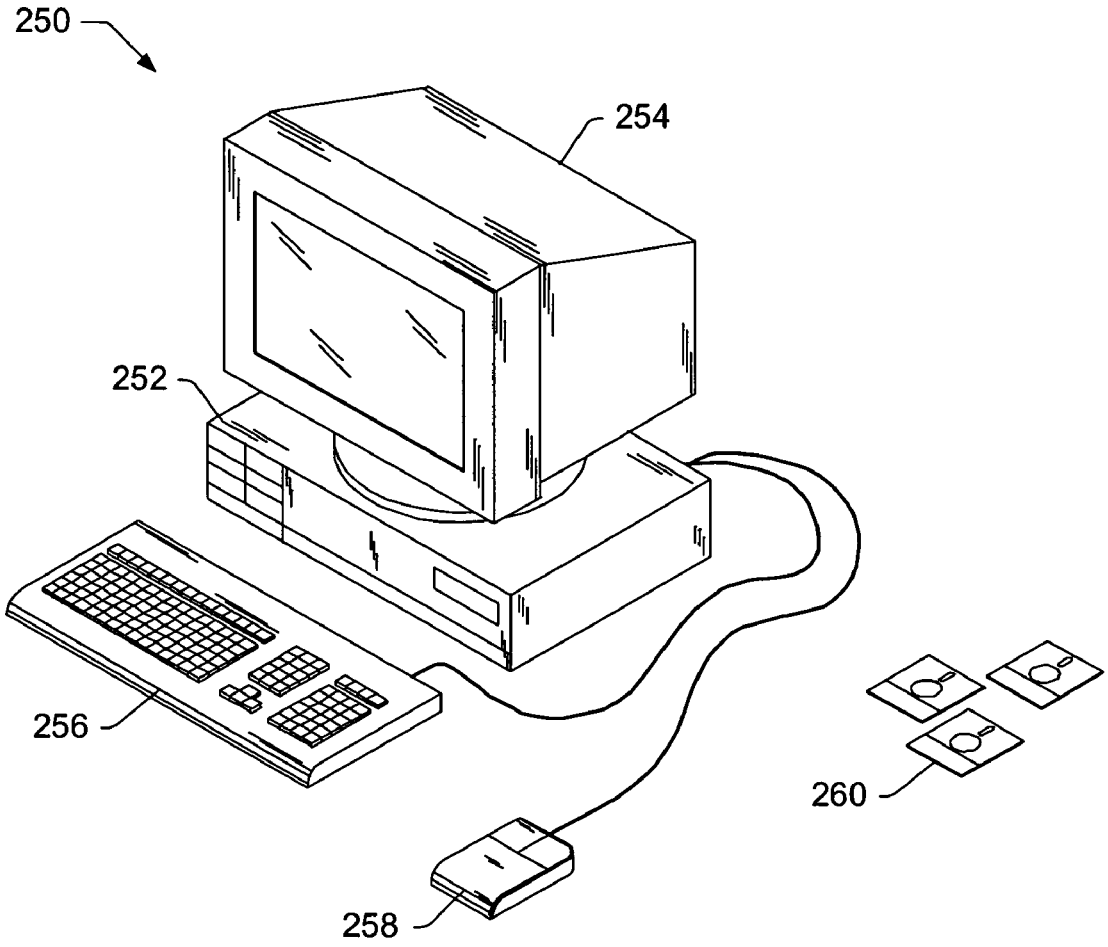
FIG. 2 illustrates an embodiment of computer system that may be suitable for implementing various tracking system embodiments.

FIG. 2 illustrates an embodiment of computer system 250 that may be suitable for implementing various embodiments of a system and method for tracking vessels. Each computer system 250 typically includes components such as CPU 252 with an associated memory medium such as floppy disks 260. The memory medium may store program instructions for computer programs. The program instructions may be executable by CPU 252. Computer system 250 may further include a display device such as monitor 254, an alphanumeric input device such as keyboard 256, and a directional input device such as mouse 258. Computer system 250 may be operable to execute the computer programs to implement computer-implemented systems and methods for tracking vessels.

Computer system 250 may include a memory medium on which computer programs according to various embodiments may be stored. The term "memory medium" is intended to include an installation medium, e.g., a CD-ROM or floppy disks 260, a computer system memory such as DRAM, SRAM, EDO RAM, Rambus RAM, etc., or a non-volatile memory such as a magnetic media, e.g., a hard drive or optical storage. The memory medium may also include other types of memory or combinations thereof. In addition, the memory medium may be located in a first computer, which executes the programs or may be located in a second different computer, which connects to the first computer over a network. In the latter instance, the second computer may provide the program instructions to the first computer for execution. Computer system 250 may take various forms such as a personal computer system, mainframe computer system, workstation, network appliance, Internet appliance, personal digital assistant ("PDA"), television system or other device. In general, the term "computer system" may refer to any device having a processor that executes instructions from a memory medium.

The memory medium may store a software program or programs operable to implement a method for tracking vessels. The software program(s) may be implemented in various ways, including, but not limited to, procedure-based techniques, component-based techniques, and/or object-oriented techniques, among others. For example, the software programs may be implemented using ActiveX controls, C++ objects, JavaBeans, Microsoft Foundation Classes ("MFC"), browser-based applications (e.g., Java applets), traditional programs, or other technologies or methodologies, as desired. A CPU such as host CPU 252 executing code and data from the memory medium may include a means for creating and executing the software program or programs according to the embodiments described herein.

In an embodiment, a vessel tracking system (e.g., a computer system and/or software executable on a computer system) may track and/or manage one or more vessels. One example of a vessel tracking system used to track and manage vessels is SureTrak™ available from NAWCAD. SureTrak™ is a government-off-the-shelf (GOTS) system that uses multiple sensors, fully integrated data acquisition, and a display system to receive, integrate, and display data from a variety of remote sensing systems. SureTrak™ may be run on commercial-off-the-shelf (COTS) computer systems and/or computer workstations. For example, SureTrak™ may operate on a Microsoft Windows® based computer system.

A vessel tracking system may include one or more functional components (e.g., sensors or sensing systems). Functional components may include, but are not limited to, an operator display system (ODS), a sensor data system (SDS), and a data base system (DBS). The functional components of the vessel tracking system may be integrated in a modular design. For example, in certain embodiments, each functional component may operate on a separate computer processor. In some embodiments, functional components may be co-located on a single computer processor. Integrating the functional components in a modular design allows a vessel tracking system to flexibly operate as either a small system with a few sensors or a relatively large system with many sensors. A modular design may also allow for easier integration of new functional components (e.g., new sensors or new sensor types) into a vessel tracking system. The modular designed vessel tracking system may also be modified to meet specific requirements required by an individual end user.

In an embodiment, a vessel tracking system may track one or more vessels. The vessels may be marine vessels (e.g., boats, ships, submarines), land vessels (e.g., trains, automobiles, trucks), and/or air vessels (e.g., airplanes, helicopters, missiles). In certain embodiments, a vessel tracking system may integrate data from one or more sensing systems to provide an integrated track of a vessel. A vessel tracking system may integrate data with varying data formats. Some examples of data formats may include, but are not limited to, CD2 (common digitizer protocol), Asterix (All-purpose Structured Radar Information Exchange), Link 11 (tactical data information link), and GPS. A vessel tracking system may simultaneously track more than one vessel. In some embodiments, a vessel tracking system may simultaneously track marine, land, and/or air vessels.

A vessel tracking system may provide a visual representation of the vessel track. For example, a vessel tracking system may visually display the vessel track on one or more display devices (e.g., a computer monitor or other visual display device). In some embodiments, a vessel tracking system may visually display more than one track on an output display. For example, a vessel tracking system may visually display tracks of two or more vessels or may visually display tracks of a single vessel acquired from two or more sensing systems (i.e., display multiple tracks of a single vessel rather than an integrated track of the single vessel).

Figure 3:
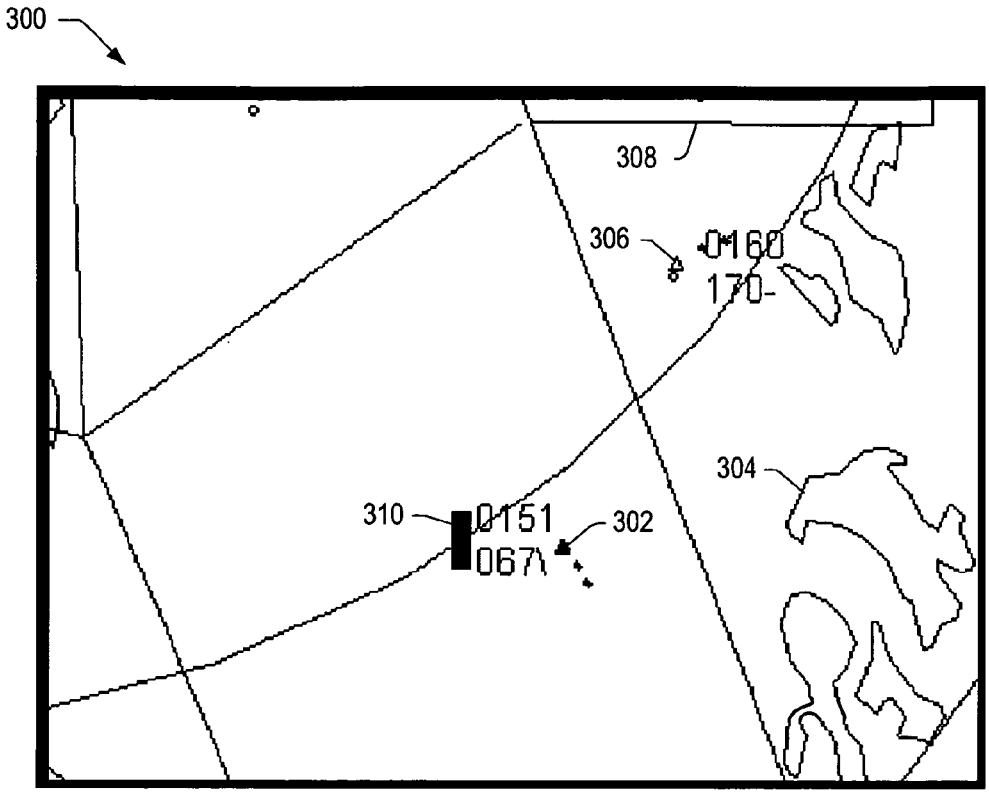
FIG. 3 depicts an example of a display of a track of an aircraft.

FIG. 3 depicts an example of a display of a track of a vessel. Display 300 may be a functional component of a vessel tracking system. In an embodiment, display 300 is a map display. Vessel 302 may be displayed on display 300. Display 300 may also display one or more other identifiable features. For example, display 300 may display geographic features 304, other vessels 306, and/or boundary information 308. Display 300 may also identify locations of other miscellaneous features such as, but not limited to, man-made objects, roads, and sensing system locations.

Display 300 may include alert condition level 310 of vessel 302. Alert condition level 310 may identify the alert condition of vessel 302. Alert condition level 310 may identify the alert condition of vessel 302 to a user (e.g., an air traffic controller or other monitoring personnel). In an embodiment, alert condition level 310 may be a level indicator (e.g., a bar level indicator). Alert condition level 310 may include color-coded identification of the alert level (e.g., red for a high alert condition, green for a low alert condition, etc.). In some embodiments, alert condition level 310 may be coupled with an audible alarm that alerts a user to a change in the alert condition of vessel 302 (e.g., an audible warning alarm for a high alert condition). Display 300 may include other advanced display features as required by a user of a vessel tracking system.

In certain embodiments, a vessel tracking system functional component may include an algorithm that displays a most recent vessel track update from a highest quality sensor or sensing system. In an embodiment, the algorithm may be a track correlation processing (TCP) algorithm. The algorithm may be a fuzzy logic algorithm. An algorithm may assign each sensor a priority value within a hierarchy of sensors. The algorithm may display a most recent vessel track update from the sensor having the highest priority in the hierarchy of sensors. In certain embodiments, certain sensors (e.g., telemetry tracking radars or Passive Coherent Location (PCL) systems) may be "position only" systems that update the position of a vessel but provide no identification data for the vessel. These "position only" systems typically update at greater rates than vessel identifying systems. An algorithm (e.g., a TCP algorithm) may correlate vessel tracks from "position only" systems with vessel tracks from vessel identifying systems (e.g., ASR-8, ASR-9, DASR-11). The algorithm may use vessel course, speed, and/or altitude information to correlate the vessel tracks. Correlating the vessel tracks may allow for rapid updating of vessel track information using a "position only" system while maintaining the identification of the vessel.

In an embodiment, a vessel tracking system functional component may include a surface surveillance module. A surface surveillance module may include surface radar (e.g., a PC-RP 201 (PC based radar processor)) used to enhance track discrimination for vessels with relatively small radar cross sections. In some embodiments, a surface surveillance module may include Furuno type surface radars. Furuno type surface radars may be used to track low-level air targets. A surface surveillance module may be combined with other modules to provide enhanced vessel tracking.

In some embodiments, a vessel tracking system functional component may include a multi-static dependent surveillance (MDS) system. An embodiment of an MDS system may be obtained from Sensis Co. (DeWitt, N.Y.). An MDS system may provide relatively fast update rates (e.g., about 1 second) and high accuracy (e.g., about 10 m to about 40 m). Fast update rates and high accuracies may be useful for monitoring of high dynamic activities of a vessel. For example, high dynamic activities of an air vessel may be monitored in research, development, test, and evaluation (RDT&E) missions. In certain embodiments, an MDS system may allow for substantially immediate notification of deviations in the flight characteristics of an air vessel (e.g., an aircraft on final approach).

In an embodiment, a vessel tracking system functional component may include an integrated camera system (ICS). ICS has been used for marine vessel applications. In certain embodiments, ICS may be used to identify low-level air vessels (e.g., low-level air vessels that are non-cooperative). Non-cooperative air vessels may include, for example, air vessels that do not respond to air traffic controller interrogation or display an Identification, Friend or Foe (IFF) signal. An ICS may include one or more camera systems. Camera systems may include, but are not limited to, daylight, thermal, short range, or long range camera systems.

In certain embodiments, a camera in an ICS system may be programmed to track a single vessel. For example, a vessel tracking system may identify a vessel in a high alert condition (e.g., the vessel may enter into an exclusive area or may cross an alert boundary). The vessel tracking system may program a camera to track the high alert condition vessel. Thus, an operator may visually identify the high alert condition vessel and assess (e.g., determine) if further action is needed in dealing with the vessel (e.g., the vessel may be identified as releasing a chemical or biological agent). In certain embodiments, a camera may be automatically slaved to track a vessel once the vessel is identified as a high alert condition vessel.

In an embodiment, a vessel tracking system functional component may include a passive coherent location (PCL) system. Examples of PCL systems include CELLDAR™ from Roke Manor Research Limited (United Kingdom) and Silent Sentry® from Lockheed-Martin Mission Systems (Gaithersburg, Md.). PCL systems may provide relatively inexpensive, all weather, passive detection and tracking of vessels.

In certain embodiments, a vessel tracking system functional component may include an automated decision support (ADS) component. An ADS component may include algorithms for providing alerts for tracked vessels. Alerts may include, but are not limited to, proximity alerts, boundary alerts, and exclusive area alerts. An alarm may be provided if a vessel crosses a boundary condition of an alert. Different alarms (e.g., visual or audio alarms) may be provided for different types of alerts. Boundary conditions (e.g., distances from a vessel) for alerts may be defined in either 2 dimensions (2-D) or 3 dimensions (3-D) around a vessel. Boundary conditions may be defined automatically by a vessel tracking system or defined by a user of a vessel tracking system. In some embodiments, boundary conditions may be modified based on an alert condition of a vessel. In certain embodiments, boundary conditions may be modified based on a transportation phase of a vessel (e.g., a flight phase of an air vessel).

A proximity alert may include an alert when two or more vessels approach within a selected distance of each other (e.g., a selected horizontal (radial) distance or a selected vertical distance (altitude)). A proximity alert may include a visual alarm and/or an audio alarm. A visual alarm may be provided on a display (e.g., display 300 shown in FIG. 3). The boundary conditions of a proximity alert may be defined by a user of a vessel tracking system. In certain embodiments, a proximity alert may be applied only to selected vessel tracks. Vessel tracks having a proximity alert may be selected by a user of a vessel tracking system or may be automatically selected by the vessel tracking system based on, for example, a flight phase of a vessel or a location of a vessel.

Figure 4:
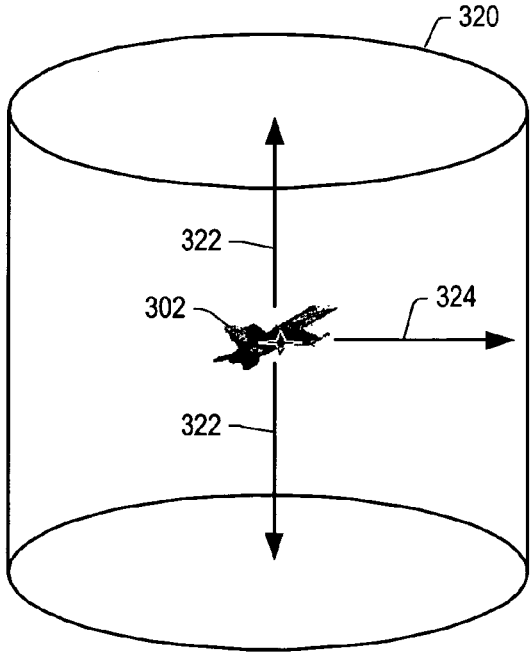
FIG. 4 depicts an example of a normal proximity alert volume for an aircraft.

FIG. 4 depicts an example of a normal proximity alert volume for an aircraft. Vessel 302 has normal proximity alert volume 320. In an embodiment, vessel 302 may be an aircraft. The boundary conditions of normal proximity alert volume 320 may be defined by vertical separation distance 322 and horizontal separation distance 324. In certain embodiments, vertical separation distance 322 may be the same above and below vessel 302. In some embodiments, vertical separation distance 322 may vary above and below vessel 302. Typical vertical separation distances 322 for an aircraft may be, for example, about 1000 feet, about 2000 feet, about 3000 feet, about 4000 feet, or about 5000 feet. Typical horizontal separation distances 324 for an aircraft may be, for example, about 3 nautical miles, about 4 nautical miles, about 5 nautical miles, or about 6 nautical miles. The separation distances may vary, for example, based on a type of vessel 302 (e.g., military or civilian aircraft). Separation distances may be defined by a user of a vessel tracking system. An alarm may be activated when another vessel enters normal proximity alert volume 320.

A boundary alert may include an alert when a vessel approaches within a selected distance of an area boundary. An area boundary may be defined in horizontal and/or vertical space. An area boundary may define an area or volume in which a vessel is restricted from traveling (e.g., a "no-fly" zone). Boundary conditions of an area boundary may be defined on a map or other geographic template. Boundary conditions of an area boundary may be predetermined according to a type of area. In an embodiment, boundary conditions of an area boundary are defined by a user of a vessel tracking system. A boundary alert may include a visual alarm and/or an audio alarm.

Figure 5:
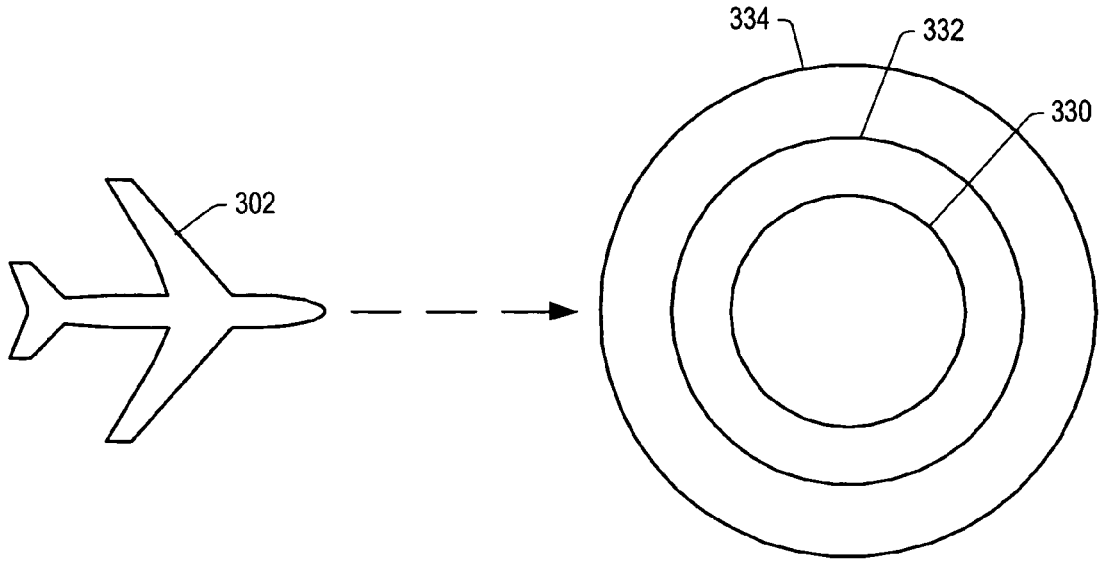
FIG. 5 depicts an example of a normal area boundary for an aircraft.

FIG. 5 depicts an example of a normal area boundary for an aircraft. Vessel 302 may approach normal area boundary 330. Normal area boundary 330 may be a 2-D area or a 3-D volume. Boundary conditions for normal area boundary 330 may include horizontal area and/or vertical area. In an embodiment, normal area boundary 330 may have a circular shape, as shown in FIG. 5. The shape of normal area boundary 330 may vary depending on the boundary conditions for the area boundary. For example, normal area boundary 330 may have a square shape, a rectangular shape, an irregular shape, etc. An alarm may be activated when vessel 302 crosses normal area boundary 330.

An exclusive area alert may include an alert when a vessel is within a defined volume or area in space (e.g., a defined volume of airspace for an air vessel). Boundary conditions for an exclusive area alert may define a volume or area in space for the exclusive area. An exclusive area alert may include a visual alarm and/or an audio alarm. In certain embodiments, an exclusive area alert may be applied only to selected vessels. For example, an exclusive area alert may be applied to a civilian vessel but not applied to a military vessel.

Figure 6:
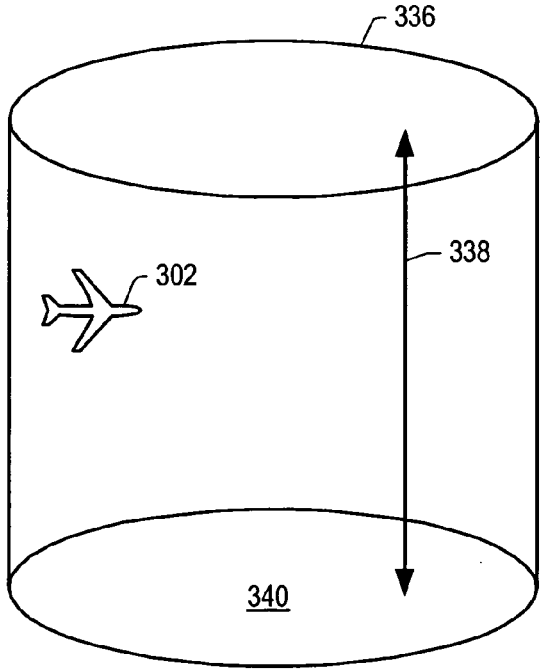
FIG. 6 depicts an example of a normal exclusive area for an aircraft.

FIG. 6 depicts an example of a normal exclusive area for an aircraft. Exclusive area volume 336 may be a volume in space. In some embodiments, exclusive area volume 336 may be an area in space. Exclusive area volume 336 may be defined by boundary conditions such as vertical height 338 and horizontal area 340. In some embodiments, other boundary conditions may define exclusive area volume 336. An alarm may be activated when vessel 302 enters exclusive area volume 336.

In certain embodiments, boundary conditions for an alert may be defined by a user of a vessel tracking system. In one embodiment, boundary conditions may be defined by a user using a graphical interface. For example, boundary conditions may be defined by using a "point and click" interface on a display (e.g., a map display).

In some embodiments, boundary conditions may be predefined in a vessel tracking system. For example, boundary conditions may be predefined on a map entered into a vessel tracking system. A user of the vessel tracking system may modify the boundary conditions (e.g., using a graphical "point and click" interface or a graphical "point and drag" interface). In certain embodiments, a user may be inhibited from modifying the boundary conditions for an alert.

Figure 7:
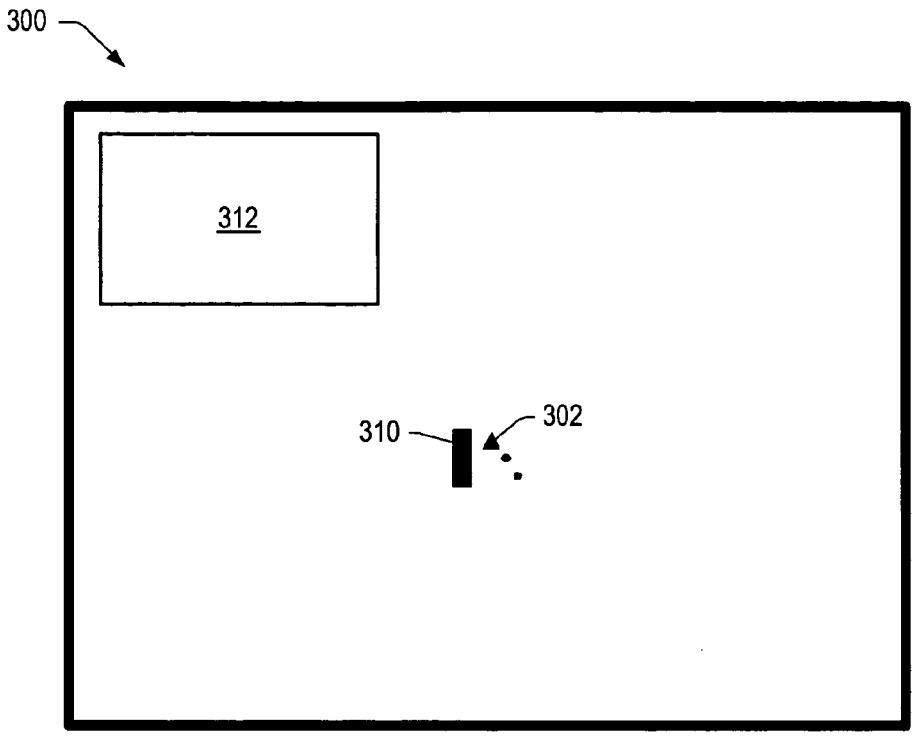
FIG. 7 depicts an example of a display of a vessel track and an alert window.

In certain embodiments, a visual alarm may include an alert window on a display. FIG. 7 depicts an example of display 300 of a vessel track and an alert window. Display 300 may show a track of vessel 302. If vessel 302 violates the boundary conditions for an alert (e.g., a boundary alert), alert window 312 may automatically appear on display 300. Alert window 312 may be an inset window on display 300. In some embodiments, a user may be prompted to open alert window 312. More than one alert window 312 may appear on display 300. For example, multiple alert windows 312 may appear for a single vessel violating boundary conditions for more than one alert and/or alert windows 312 may appear for several vessels. Alert window 312 may have a size, zoom level, and/or screen position predetermined by a user or an operator of a vessel tracking system. The size, zoom level, and/or screen position of alert window 312 may also be modified after the alert window appears on display 300. In some embodiments, alert window 312 may be include a color border (e.g., a red border) and/or may be associated with an audio alarm.

In certain embodiments, a vessel tracking functional component may include a component that identifies and alerts a user of a vessel that exceeds normal travel characteristics (e.g., an aircraft that exceeds a normal flight envelope or has abnormal flight characteristics). One example of such a component is a high-dynamic notification and alert (HDNA™) component. A vessel tracking functional component may automatically identify and alert a user of a vessel that exceeds normal travel characteristics. For an air vessel, flight characteristics may include, but are not limited to, horizontal velocity (distance per time (e.g., knots)), vertical velocity (distance per time (e.g., feet per minute)), rate of heading change (heading per time (e.g., degrees per second), altitude, heading, speed change (either horizontal, vertical, or normalized) (velocity change per time (e.g., knots per second)), IFF signal loss (the maximum amount of time an aircraft may not report IFF before generating an alert condition), route deviation distance (the maximum distance an aircraft may deviate from a planned route of flight between two points before generating an alert condition), and route deviation angle (the maximum angle an aircraft may deviate from a planned route of flight between two points before generating an alert condition). Route deviation angle may typically allow for route angle deviations caused by aircraft spacing, weather, and/or direct routing changes.

Figure 8:
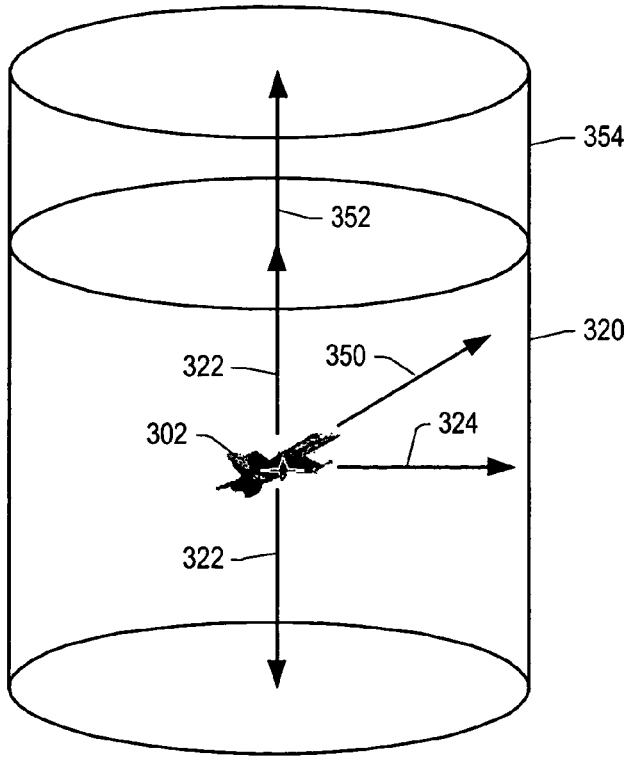
FIG. 8 depicts an example of a proximity alert volume for an aircraft with an increased vertical area.
Figure 8A:
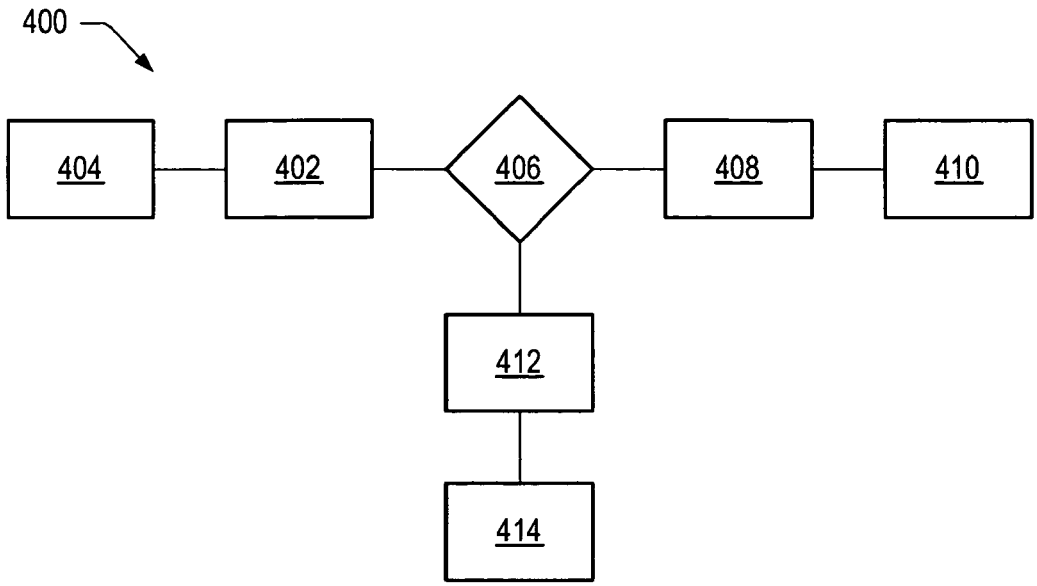
FIG. 8A depicts a flowchart for an embodiment for tracking a vessel.

FIG. 8A depicts a flowchart for an embodiment for tracking a vessel. In an embodiment, vessel tracking system 400 may monitor one or more flight characteristics 402 of an aircraft. The flight characteristics of the aircraft may be used to assess (e.g., determine) dynamic state 404 of the aircraft (i.e., the in-flight conditions of the aircraft). A functional component of the vessel tracking system (e.g., HDNA™) may compare 406 monitored flight characteristics 402 (i.e., flight characteristics of the dynamic state) to a set of predetermined values for normal flight characteristics 408 (i.e., flight characteristics of a normal dynamic state 410) to provide alert condition 412 for the aircraft. If at least one of monitored flight characteristics 402 deviates from (e.g., exceeds) a predetermined value for normal flight characteristic 408 by a selected amount, the alert condition of the aircraft may be raised. For example, if the horizontal velocity (i.e., speed) of an aircraft exceeds a predetermined horizontal velocity for the aircraft, the alert condition for the aircraft may be raised. If the aircraft's horizontal velocity returns to a value below the predetermined horizontal velocity, the alert condition for the aircraft may return to its prior level. Predetermined values for normal flight characteristics may be defined by a user of a vessel tracking system. Predetermined values for normal flight characteristics may be based on, for example, vessel type, vessel location, vessel route, etc.

The alert condition or the change in alert condition for the aircraft may be reported 414 to a user of a vessel tracking system. The alert condition for the aircraft may be visually reported to the user. For example, the alert condition may be identified on a visual display available to the user. FIG. 3 depicts an example of alert condition level 310 identified for vessel 302. Alert condition level 310 may not be shown when vessel 302 is not in a raised alert condition.

In certain embodiments, the alert condition for a vessel may have more than one alert condition level (e.g., 3, 4, 5, or more alert condition levels). In an embodiment, an aircraft may have a set of predetermined horizontal velocities, predetermined vertical velocities, and/or predetermined heading change rates. If the horizontal velocity, vertical velocity, and/or heading change rate of the aircraft deviates from (e.g., exceeds) the predetermined values, the alert condition for the aircraft may be raised. In certain embodiments, an aircraft may have more than one predetermined value for any of the flight characteristics (e.g., horizontal velocity). Each predetermined flight characteristic value may correspond to a selected increase in the alert condition for the aircraft. For example, an aircraft may have a first predetermined horizontal velocity for a first alert condition level, a second predetermined horizontal velocity (e.g., a horizontal velocity higher than the first predetermined horizontal velocity) for a second alert condition level, a third predetermined horizontal velocity for a third alert condition level, etc. As such, the more the flight characteristic of an aircraft deviates from (e.g., exceeds) a predetermined value of a normal flight characteristic, the higher the alert condition level may be for the aircraft. Generally, the higher the alert condition level of a vessel, the more imminent danger the vessel is in and/or the greater a threat posed by the vessel.

In certain embodiments, boundary conditions for an alert (e.g., a proximity alert, a boundary alert, or an exclusive area alert) may be increased to enclose more volume or area when the alert condition of a vessel increases. A vessel tracking system functional component (e.g., HDNA™) may automatically increase the boundary conditions for an alert. Increasing the boundary conditions for an alert when the alert condition of a vessel increases provides an earlier alarm to allow a user greater lead-time in dealing with the alarm. Allowing a user a greater lead-time to deal with the alarm may increase the time and the ability of the user to determine a response (e.g., a solution) to the alarm and avert a dangerous or life-threatening situation.

In certain embodiments, predetermined values for normal flight characteristics (or a normal dynamic state) may be modified (e.g., raised or lowered) based on a flight phase of a vessel. Flight phases may include, but are not limited to, takeoff, enroute, terminal or approach, and landing. Thus, alert condition levels may vary based on a flight phase of a vessel. For example, a high vertical velocity and rapid rate of heading change may produce a higher alert condition level for an aircraft enroute than for an aircraft during its approach. The flight phase of an aircraft may be input by a user of a vessel tracking system or may be automatically assessed by the vessel tracking system (e.g., based on a location of the vessel or based on which sensing system is tracking the vessel).

FIG. 5 depicts an example of normal area boundary 330 and increased area boundaries 332, 334. Area boundaries 332, 334 may have increased areas or volumes compared to normal area boundary 330. The area or volume of an area boundary may be increased because a flight characteristic of vessel 302 exceeds a predetermined value of a normal flight characteristic.

As another example, FIG. 8 depicts an example of a proximity alert volume for an aircraft with an increased vertical area relative to the normal proximity alert volume depicted in FIG. 4. In FIG. 8, vessel 302 may have vertical velocity 350 that exceeds a predetermined value and thus raises the alert condition of the vessel. A vessel tracking system functional component may automatically increase vertical distance 322 by vertical distance 352 in the direction of the vertical velocity (e.g., upwards). Increasing the vertical distance increases the alert volume from normal proximity alert volume 320 to extended proximity alert volume 354.

Figure 9:
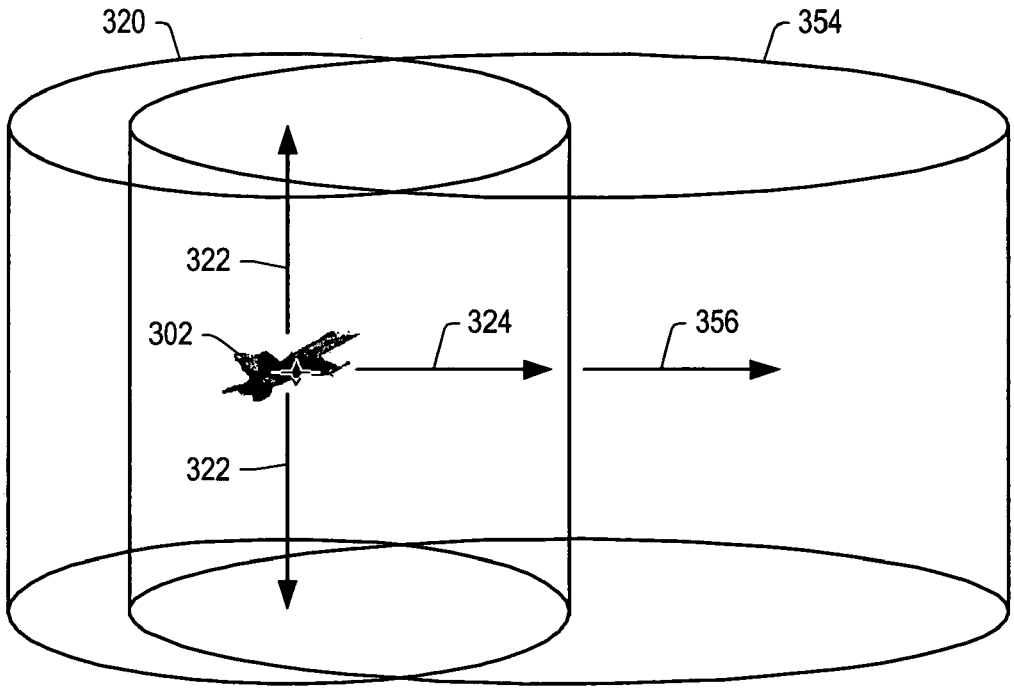
FIG. 9 depicts an example of a proximity alert volume for an aircraft with an increased horizontal area.

As another example, FIG. 9 depicts an example of a proximity alert volume for an aircraft with an increased horizontal area relative to the normal proximity alert volume depicted in FIG. 4. In FIG. 9, vessel 302 may have horizontal velocity 356 that exceeds a predetermined value and thus raises the alert condition of the vessel. A vessel tracking system functional component may automatically increase normal proximity alert volume 320 to extended proximity alert volume 354. Extended proximity alert volume 354 may be increased in the look ahead direction for vessel 302 due to the increased horizontal velocity while the look behind area may be decreased, as shown in FIG. 9. In some embodiments, the look behind area may remain substantially the same for normal proximity alert volume 320 and extended proximity alert volume 354.

Figure 10:
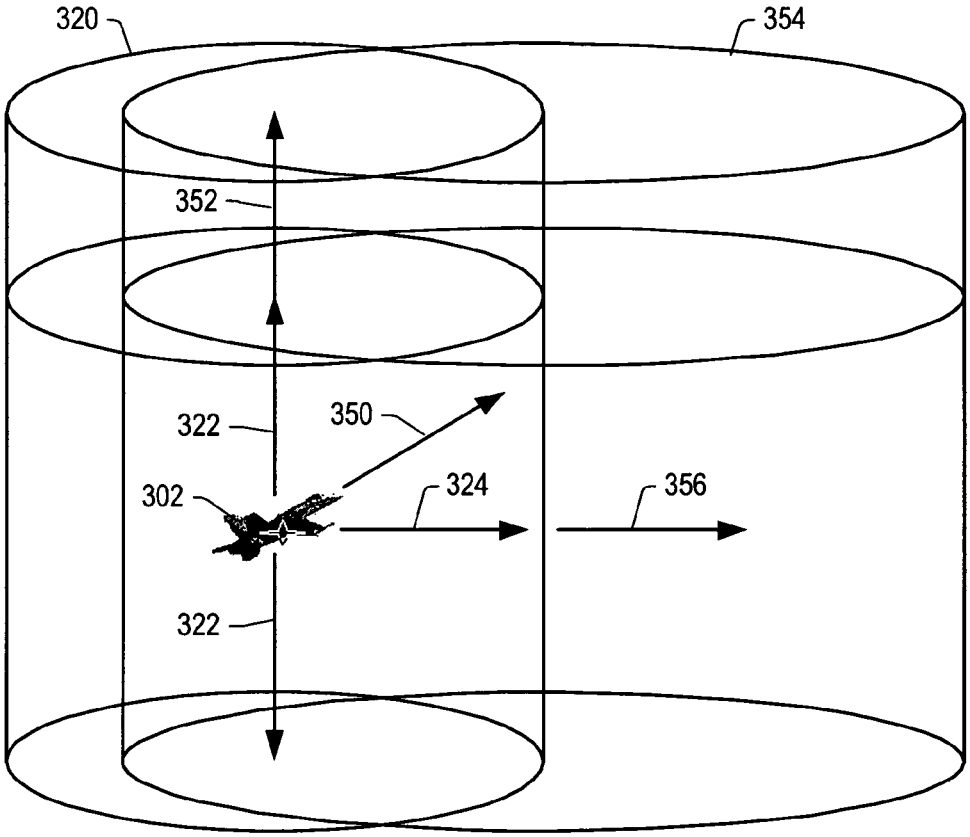
FIG. 10 depicts an example of a proximity alert volume for an aircraft with increased vertical area and an increased horizontal area.

FIG. 10 depicts an example of a proximity alert volume for an aircraft with increased vertical area and increased horizontal area relative to the normal proximity alert volume depicted in FIG. 4. When vertical velocity 350 and horizontal velocity 356 both exceed predetermined values, extended proximity alert volume 354 may be increased in both the vertical and horizontal directions.

Figure 11:
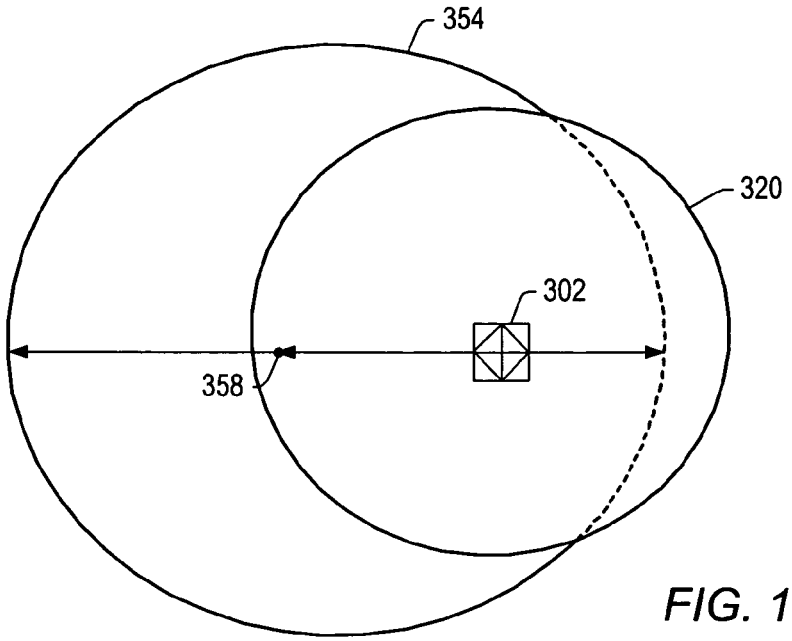
FIG. 11 depicts a top view of the proximity alert volume of FIG. 10 showing both normal and increased horizontal areas and horizontal look ahead point.

FIG. 11 depicts a top view of the proximity alert volume of FIG. 10 showing both normal and increased horizontal areas and horizontal look ahead point. Look ahead point 358 may be determined by selecting a look ahead time frame and multiplying the look ahead time frame by the horizontal velocity of the vessel.

Figure 12:
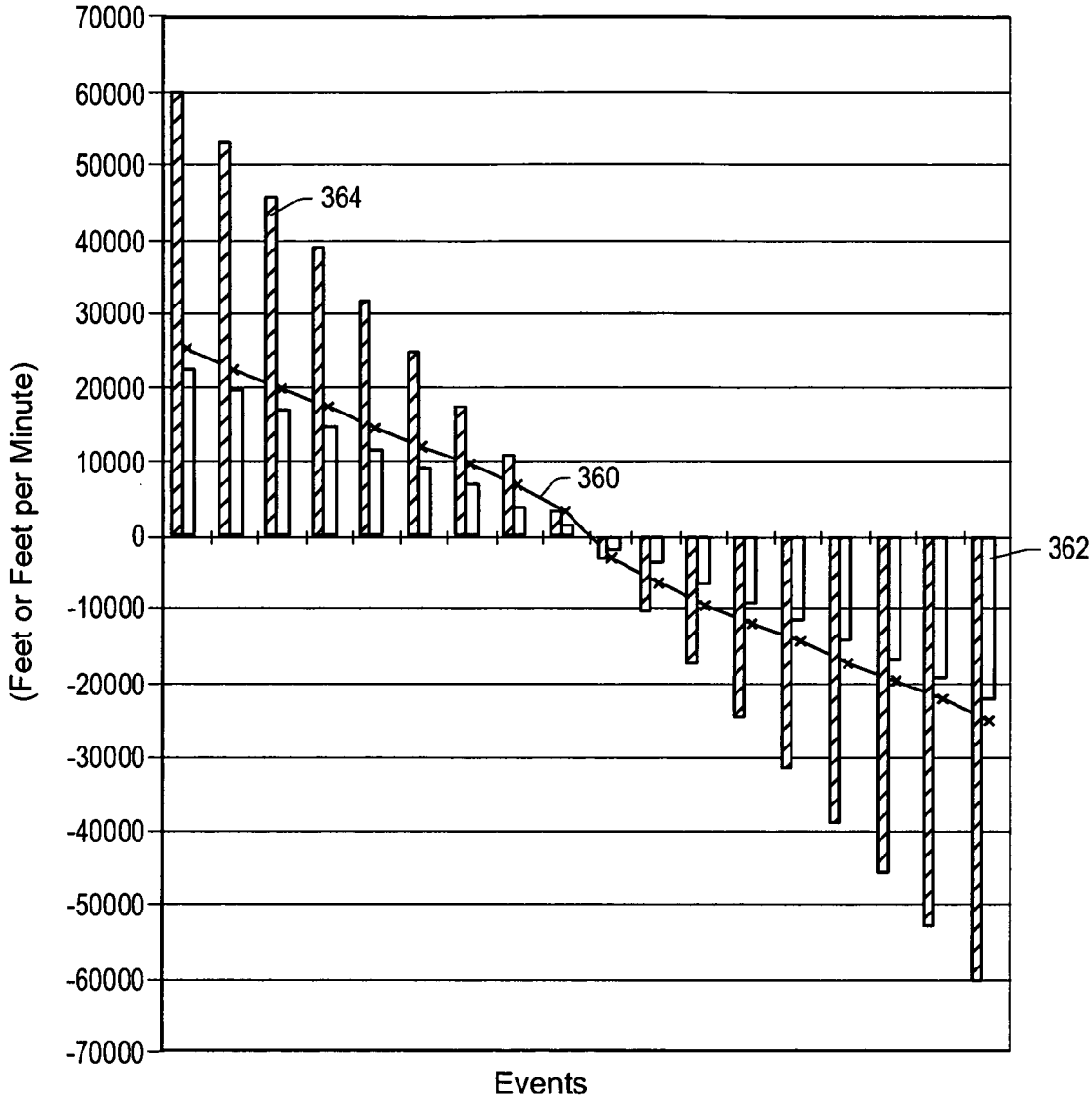
FIG. 12 depicts maximum vertical proximity alert volume extent and maximum vertical look ahead travel along with vertical velocity in an example.

In an example, extended volume calculations were made for a vessel given a normal proximity alert volume with a horizontal separation radius of 3.5 nautical miles (NM) and a vertical separation distance of 3000 feet. The look ahead time was set at 22 seconds. Predetermined values were set at 4000 knots for horizontal velocity, 8000 feet per minute for vertical velocity, and 8 degrees per second for rate of heading change. FIG. 12 depicts sets of values for maximum vertical proximity alert volume extent 360 in feet and maximum vertical look ahead travel 362 in feet along with vertical velocity 364 in feet per minute determined in the example. FIG. 12 shows the relationships between vertical proximity alert volume, maximum vertical look ahead travel, and vertical velocity for several events according to the example.

Figure 13:
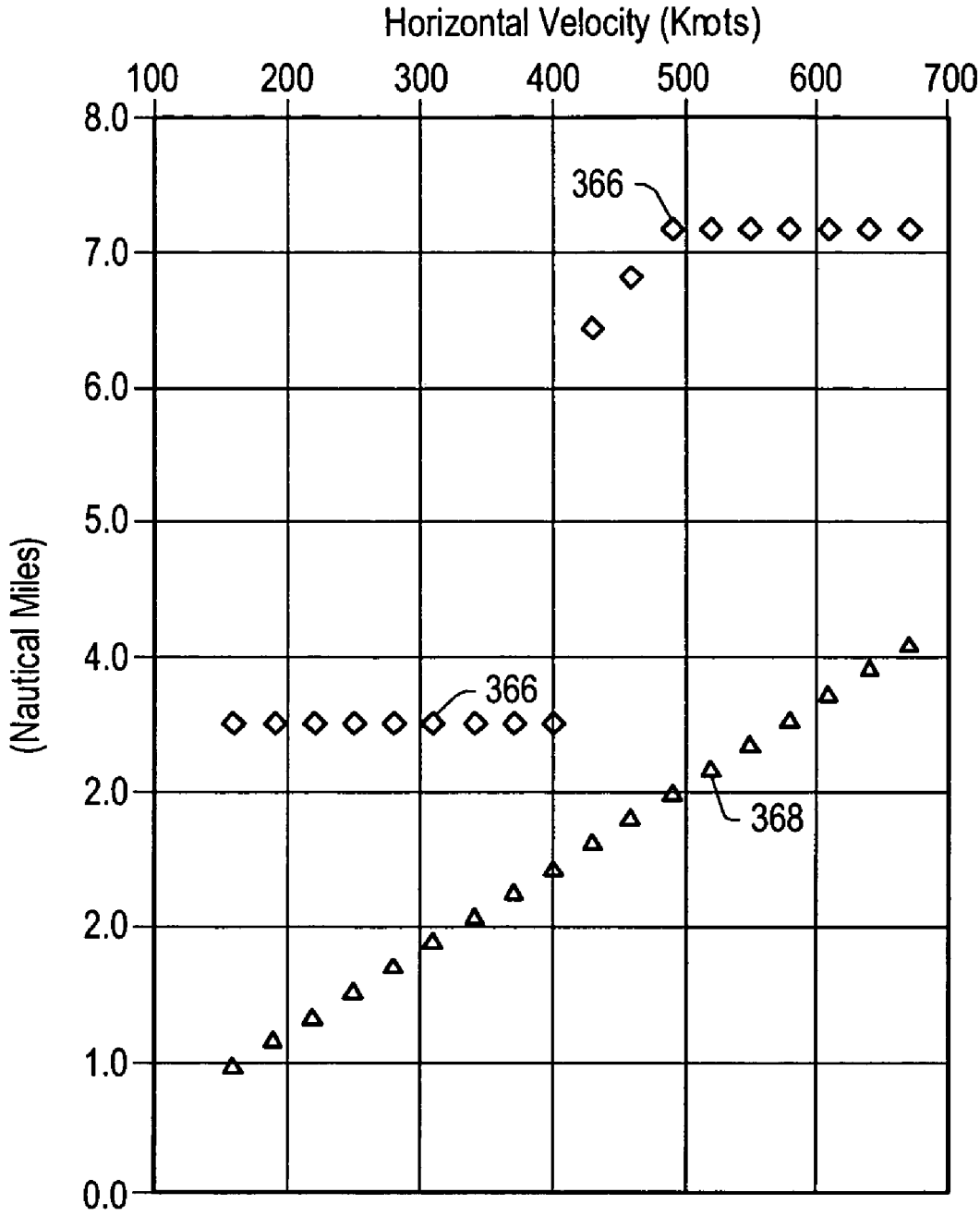
FIG. 13 depicts maximum horizontal proximity alert volume extent and maximum horizontal look ahead travel versus horizontal velocity in an example.
Figure 14:
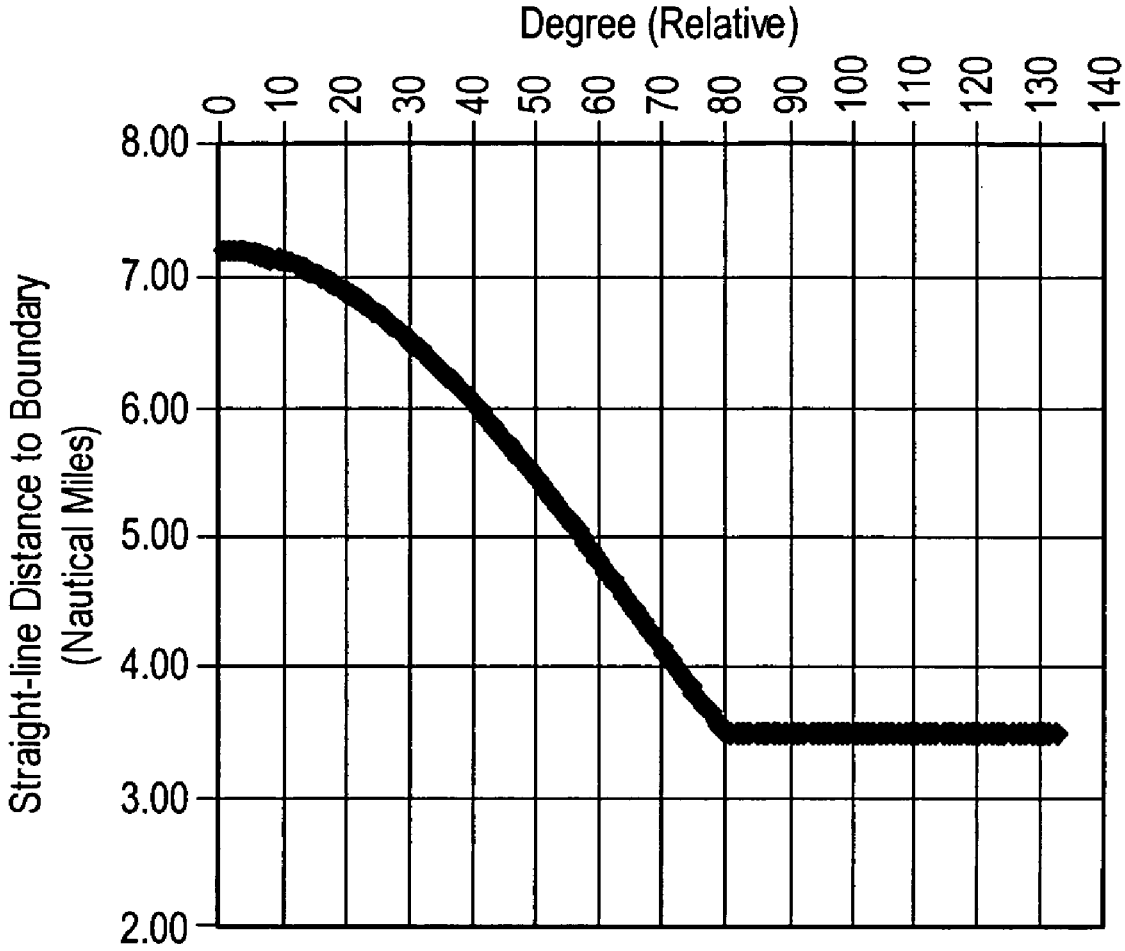
FIG. 14 depicts straight-line distance to a boundary of the proximity alert volume versus angle relative to aircraft direction in an example.

FIG. 13 depicts values for maximum horizontal proximity alert volume extent 366 and maximum horizontal look ahead travel 368 versus horizontal velocity (knots) determined in the example. FIG. 13 shows the changes in horizontal proximity alert volume for various parameters according to the example. FIG. 14 depicts straight-line distance to a boundary of the proximity alert volume versus angle relative to aircraft direction determined in the example for an aircraft horizontal velocity of 650 knots.

In certain embodiments, a vessel tracking system functional component may be adapted for security applications (e.g., Homeland Air Security applications). In an embodiment, a vessel tracking system may be coupled (e.g., linked through the Internet) to a flight data system (e.g., the Federal Aviation Administration's (FAA's) flight data system. Alerts may be provided for prohibited areas (e.g., boundary alerts) and/or prohibited routes (e.g., exclusive area alerts). Aircraft that deviate or exceed predetermined flight characteristics may be identified as "special interest" aircraft.

In some embodiments, a vessel tracking system may include a buffered display system. A buffered display system may allow a user to view a replay of what has appeared on a display in one window (e.g., an inset window) while real-time data is displayed in another window (e.g., a main window). In certain embodiments, a buffered display system may allow for up to about 5 minutes of replay. Using a buffered display system may allow for more immediate access to replay footage to improve analysis of the travel characteristics of a vessel.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method for detecting and reporting in-flight alert conditions of a plurality of aircraft using a computer system, comprising:

monitoring one or more flight characteristics of the plurality of aircraft with the computer system, wherein the computer system is not on-board any of the plurality of aircraft;

comparing at least one of the flight characteristics to one or more normal flight characteristics to assess an alert condition of at least one of the plurality of aircraft with the computer system; and reporting the alert condition of at least one of the plurality of aircraft with the computer system.

2. The method of claim 1, wherein the alert condition comprises an alert level of at least one of the plurality of aircraft corresponding to a danger level or threat level of the aircraft based on at least one of the flight characteristics.

3. The method of claim 1, further comprising changing the alert condition when at least one of the flight characteristics deviates from at least one of the normal flight characteristics.

4. The method of claim 1, further comprising alerting a user of one or more abnormal flight characteristics of at least one of the plurality of aircraft if at least one of the flight characteristics deviates from at least one of the normal flight characteristics.

5. The method of claim 1, further comprising increasing the alert condition when at least one of the flight characteristics deviates from a predetermined value of at least one of the normal flight characteristics.

6. The method of claim 1, further comprising increasing the alert condition to a selected level when at least one of the flight characteristics deviates from a predetermined value of at least one of the normal flight characteristics.

7. The method of claim 6, wherein the selected level of the alert condition is determined by the predetermined value of the at least one of the normal flight characteristics that has been deviated from.

8. The method of claim 1, further comprising increasing the alert condition to a first selected level when at least one of the flight characteristics deviates from a first predetermined value of at least one of the normal flight characteristics or increasing the alert condition to a second selected level when at least one of the flight characteristics deviates from a second predetermined value of at least one of the normal flight characteristics.

9. The method of claim 1, further comprising visually reporting the alert condition of at least one of the plurality of aircraft.

10. The method of claim 1, further comprising reporting the alert condition of at least one of the plurality of aircraft on a display.

11. The method of claim 1, further comprising defining a proximity alert volume around at least one of the plurality of aircraft.

12. The method of claim 11, further comprising providing an alarm if another aircraft enters the proximity alert volume.

13. The method of claim 11, further comprising increasing boundary conditions of the proximity alert volume if at least one of the flight characteristics deviates from at least one of the normal flight characteristics.

14. The method of claim 1, further comprising defining a boundary of an area, wherein the area is an area in which at least one of the plurality of aircraft is restricted from traveling.

15. The method of claim 14, further comprising providing an alarm if at least one of the plurality of aircraft crosses the area boundary.

16. The method of claim 14, further comprising increasing boundary conditions of the area boundary if at least one of the flight characteristics deviates from at least one of the normal flight characteristics.

17. The method of claim 1, further comprising defining an exclusive area for at least one of the plurality of aircraft.

18. The method of claim 17, further comprising providing an alarm if at least one of the plurality of aircraft enters the exclusive area.

19. The method of claim 17, further comprising increasing boundary conditions of the exclusive area if at least one of the flight characteristics deviates from at least one of the normal flight characteristics.

20. The method of claim 1, further comprising modifying one or more of the flight characteristics if at least one of the flight characteristics deviates from at least one of the normal flight characteristics.

21. The method of claim 1, further comprising modifying at least one of the normal flight characteristics based on a flight phase of at least one of the plurality of aircraft.

22. The method of claim 21, wherein the flight phase comprises a takeoff of at least one of the plurality of aircraft.

23. The method of claim 21, wherein the flight phase comprises at least one of the plurality of aircraft enroute.

24. The method of claim 21, wherein the flight phase comprises an approach of at least one of the plurality of aircraft.

25. The method of claim 21, wherein the flight phase comprises a landing of at least one of the plurality of aircraft.

26. The method of claim 1, wherein at least one of the flight characteristics comprises a horizontal velocity of at least one of the plurality of aircraft.

27. The method of claim 1, wherein at least one of the flight characteristics comprises a vertical velocity of at least one of the plurality of aircraft.

28. The method of claim 1, wherein at least one of the flight characteristics comprises a rate of heading change of at least one of the plurality of aircraft.

29. The method of claim 1, wherein at least one of the flight characteristics comprises an altitude of at least one of the plurality of aircraft.

30. The method of claim 1, wherein at least one of the flight characteristics comprises a speed change of at least one of the plurality of aircraft.

31. The method of claim 1, wherein at least one of the flight characteristics comprises a heading of at least one of the plurality of aircraft.

32. The method of claim 1, wherein at least one of the flight characteristics comprises an IFF signal of at least one of the plurality of aircraft.

33. The method of claim 1, wherein at least one of the flight characteristics comprises route deviation distance of at least one of the plurality of aircraft.

34. The method of claim 1, wherein at least one of the flight characteristics comprises route deviation angle of at least one of the plurality of aircraft.

35. A method for detecting and reporting a state of a plurality of aircraft using a computer system, comprising:

monitoring one or more flight characteristics of the plurality of aircraft with the computer system, wherein the computer system is remotely located from the plurality of aircraft;

assessing a dynamic state of at least one of the plurality of aircraft from the one or more flight characteristics with the computer system;

comparing the dynamic state of at least one of the plurality of aircraft to a normal dynamic state for the aircraft with the computer system; and modifying one or more boundary conditions of an alert for at least one of the plurality of aircraft if at least one of the flight characteristics of the dynamic state of the aircraft deviates from a predetermined value of at least one normal flight characteristic of the normal dynamic state with the computer system.

36. The method of claim 35, further comprising defining one or more normal boundary conditions of the alert corresponding to the normal dynamic state of at least one of the plurality of aircraft.

37. The method of claim 35, further comprising increasing at least one of the boundary conditions of the alert for at least one of the plurality of aircraft if at least one flight characteristic of the dynamic state of the aircraft deviates from a predetermined value of at least one of the normal flight characteristics of the normal dynamic state.

38. The method of claim 35, wherein the alert comprises a proximity alert.

39. The method of claim 35, wherein the alert comprises a boundary alert.

40. The method of claim 35, wherein the alert comprises an exclusive area alert.

41. The method of claim 35, further comprising reporting a result of the comparison.

42. The method of claim 35, further comprising visually reporting a result of the comparison.

43. The method of claim 35, further comprising visually reporting a modification in at least one of the boundary conditions.

44. The method of claim 35, further comprising changing an alert condition of at least one of the plurality of aircraft if at least one of the flight characteristics of the dynamic state of the aircraft deviates from a predetermined value of at least one of the normal flight characteristics of the normal dynamic state.

45. The method of claim 35, further comprising increasing an alert condition of at least one of the plurality of aircraft if at least one of the flight characteristics of the dynamic state of the aircraft deviates from a predetermined value of at least one of the normal flight characteristics of the normal dynamic state.

46. The method of claim 35, further comprising reporting an alert condition of at least one of the plurality of aircraft.

47. The method of claim 35, further comprising providing an alarm when at least one of the boundary conditions of the alert is crossed.

48. The method of claim 35, further comprising alerting a user of an abnormal dynamic state if at least one of the flight characteristics of the dynamic state of at least one of the plurality of aircraft deviates from a predetermined value of at least one of the normal flight characteristics of the normal dynamic state.

49. The method of claim 35, further comprising modifying one or more of the flight characteristics if at least one of the flight characteristics of the dynamic state of at least one of the plurality of aircraft deviates from a predetermined value of at least one of the normal flight characteristics of the normal dynamic state.

50. The method of claim 35, further comprising modifying at least one predetermined value of at least one of the normal flight characteristics of the normal dynamic state based on a flight phase of at least one of the plurality of aircraft.

51. The method of claim 50, wherein the flight phase comprises a takeoff of at least one of the plurality of aircraft.

52. The method of claim 50, wherein the flight phase comprises at least one of the plurality of aircraft enroute.

53. The method of claim 50, wherein the flight phase comprises an approach of at least one of the plurality of aircraft.

54. The method of claim 50, wherein the flight phase comprises a landing of at least one of the plurality of aircraft.

55. The method of claim 35, wherein at least one of the flight characteristics comprises a horizontal velocity of at least one of the plurality of aircraft.

56. The method of claim 35, wherein at least one of the flight characteristics comprises a vertical velocity of at least one of the plurality of aircraft.

57. The method of claim 35, wherein at least one of the flight characteristics comprises a rate of heading change of at least one of the plurality of aircraft.

58. The method of claim 35, wherein at least one of the flight characteristics comprises an altitude of at least one of the plurality of aircraft.

59. The method of claim 35, wherein at least one of the flight characteristics comprises a speed change of at least one of the plurality of aircraft.

60. The method of claim 35, wherein at least one of the flight characteristics comprises a heading of at least one of the plurality of aircraft.

61. The method of claim 35, wherein at least one of the flight characteristics comprises an IFF signal of at least one of the plurality of aircraft.

62. The method of claim 35, wherein at least one of the flight characteristics comprises route deviation distance of at least one of the plurality of aircraft.

63. The method of claim 35, wherein at least one of the flight characteristics comprises route deviation angle of at least one of the plurality of aircraft.

64. A method for detecting and reporting in-flight alert conditions of a plurality of aircraft using an earthbound computer system, comprising:

monitoring one or more flight characteristics of the plurality of aircraft with the earthbound computer system;

assessing one or more normal flight characteristics of at least one of the plurality of aircraft based on a flight phase of the aircraft with the earthbound computer system;

comparing at least one of the flight characteristics to one or more of the normal flight characteristics to assess an alert condition of at least one of the plurality of aircraft with the earthbound computer system; and reporting the alert condition of at least one of the aircraft with the earthbound computer system.

65. The method of claim 64, wherein the alert condition comprises an alert level for at least one of the plurality of aircraft corresponding to a danger level or threat level for the aircraft based on at least one of the flight characteristics.

66. The method of claim 64, further comprising changing the alert condition when at least one of the flight characteristics deviates from at least one of the normal flight characteristics.

67. The method of claim 64, further comprising alerting a user of abnormal flight characteristics of at least one of the plurality of aircraft if at least one of the flight characteristics deviates from at least one of the normal flight characteristics.

68. The method of claim 64, further comprising increasing the alert condition when at least one of the flight characteristics deviates from a predetermined value of at least one of the normal flight characteristics.

69. The method of claim 64, further comprising increasing the alert condition to a selected level when at least one of the flight characteristics deviates from a predetermined value of at least one of the normal flight characteristics.

70. The method of claim 69, wherein the selected level of the alert condition is determined by the predetermined value of the at least one of the normal flight characteristics that has been exceeded.

71. The method of claim 64, further comprising increasing the alert condition to a first selected level when at least one of the flight characteristics deviates from a first predetermined value of at least one of the normal flight characteristics or increasing the alert condition to a second selected level when at least one of the flight characteristics deviates from a second predetermined value of at least one of the normal flight characteristics.

72. The method of claim 64, further comprising visually reporting the alert condition of at least one of the plurality of aircraft.

73. The method of claim 64, further comprising reporting the alert condition of at least one of the plurality of aircraft on a display.

74. The method of claim 64, further comprising defining a proximity alert volume around at least one of the plurality of aircraft.

75. The method of claim 74, further comprising providing an alarm if another aircraft enters the proximity alert volume.

76. The method of claim 74, further comprising increasing boundary conditions of the proximity alert volume if at least one of the flight characteristics deviates from at least one of the normal flight characteristics.

77. The method of claim 64, further comprising defining a boundary of an area, wherein the area is an area in which at least one of the plurality of aircraft is restricted from traveling.

78. The method of claim 77, further comprising providing an alarm if at least one of the plurality of aircraft crosses the area boundary.

79. The method of claim 77, further comprising increasing boundary conditions of the area boundary if at least one of the flight characteristics deviates from at least one of the normal flight characteristics.

80. The method of claim 64, further comprising defining an exclusive area for at least one of the plurality of aircraft.

81. The method of claim 80, further comprising providing an alarm if at least one of the plurality of aircraft enters the exclusive area.

82. The method of claim 80, further comprising increasing boundary conditions of the exclusive area if at least one of the flight characteristics deviates from at least one of the normal flight characteristics.

83. The method of claim 64, further comprising modifying one or more of the flight characteristics if at least one of the flight characteristics deviates from at least one of the normal flight characteristics.

84. The method of claim 64, wherein the flight phase comprises a takeoff of at least one of the plurality of aircraft.

85. The method of claim 64, wherein the flight phase comprises at least one of the plurality of aircraft enroute.

86. The method of claim 64, wherein the flight phase comprises an approach of at least one of the plurality of aircraft.

87. The method of claim 64, wherein the flight phase comprises a landing of at least one of the plurality of aircraft.

88. The method of claim 64, wherein at least one of the flight characteristics comprises a horizontal velocity of at least one of the plurality of aircraft.

89. The method of claim 64, wherein at least one of the flight characteristics comprises a vertical velocity of at least one of the plurality of aircraft.

90. The method of claim 64, wherein at least one of the flight characteristics comprises a rate of heading change of at least one of the plurality of aircraft.

91. The method of claim 64, wherein at least one of the flight characteristics comprises an altitude of at least one of the plurality of aircraft.

92. The method of claim 64, wherein at least one of the flight characteristics comprises a speed change of at least one of the plurality of aircraft.

93. The method of claim 64, wherein at least one of the flight characteristics comprises a heading of at least one of the plurality of aircraft.

94. The method of claim 64, wherein at least one of the flight characteristics comprises an IFF signal of at least one of the plurality of aircraft.

95. The method of claim 64, wherein at least one of the flight characteristics comprises route deviation distance of at least one of the plurality of aircraft.

96. The method of claim 64, wherein at least one of the flight characteristics comprises route deviation angle of at least one of the plurality of aircraft.

* * * * *